United States Patent [19]

Beckstrom et al.

[11] Patent Number: 4,494,682

[45] **Date of Patent: * Jan. 22, 1985**

[54] POURING FITMENT WITH CONTAINER AND CLOSURE THEREFOR

[75] Inventors: Ronald D. Beckstrom, Fullerton; Chester C. Anderson, Santa Ana, both of Calif.

[73] Assignee: Hunt-Wesson Foods, Inc., Fullerton, Calif.

[ * ] Notice: The portion of the term of this patent subsequent to Oct. 9, 2001 has been disclaimed.

[21] Appl. No.: 396,025

[22] Filed: Jul. 7, 1982

[51] Int. Cl.[3] ..... B65D 25/48

[52] U.S. Cl. ..... 222/551; 222/570

[58] Field of Search ..... 222/551, 562, 570, 571, 222/568, 567, 542; 215/346

[56] References Cited

U.S. PATENT DOCUMENTS

| | | | |
|---|---|---|---|
| 2,715,480 | 8/1955 | Livingstone | 222/562 UX |
| 2,785,841 | 3/1957 | Westgate . | |
| 2,834,497 | 5/1958 | Wolf . | |
| 2,848,145 | 8/1958 | Livingstone | 222/542 |
| 2,854,163 | 9/1958 | Barney . | |
| 2,917,198 | 12/1959 | Beall, Jr. . | |
| 2,964,208 | 12/1960 | Heyl et al. . | |
| 3,089,621 | 5/1963 | Livingstone | 222/551 X |
| 3,311,275 | 3/1967 | Gibson | 222/567 |
| 3,325,034 | 6/1967 | Squire . | |
| 3,338,448 | 8/1967 | Squire . | |
| 4,196,819 | 4/1980 | Fontanaud | 222/568 X |

FOREIGN PATENT DOCUMENTS

| | | | |
|---|---|---|---|
| 1063482 | 8/1959 | Fed. Rep. of Germany | 222/251 |

*Primary Examiner*—Stanley H. Tollberg

*Attorney, Agent, or Firm*—Pretty, Schroeder, Brueggemann & Clark

[57] ABSTRACT

A pouring fitment defines an inwardly facing recess that receives an outwardly extending annular holding portion of a mating container and an annular sealing bead on the fitment engages the holding portion. A lip of the fitment that defines a pouring surface is received and deformed by a cradle defined by a closure. Extending downwardly from the closure is a support member that presses the fitment against the container.

13 Claims, 5 Drawing Figures

POURING FITMENT WITH CONTAINER AND CLOSURE THEREFOR

FIELD OF THE INVENTION

The present invention relates to pouring fitments that are used in combination with containers to prevent the liquid contents of the containers from dripping, and, more particularly, to said fitments as they are used in combination with containers and removable closures for the containers.

BACKGROUND OF THE INVENTION

When a liquid is poured from a container, it is often found that it is difficult to terminate pouring without having one or more drops of the liquid run down the outside of the container. This tendency to drip is largely a characteristic of the container itself, rather than a function of the pouring motion. Thus, it is known by those skilled in the art that dripping can be substantially eliminated by a combination of a properly contoured mouth or lip on the container and a non-wetting pouring surface on the lip. A well designed no-drip container will actually cause the last drops of a liquid to be pulled back into the container even if they have passed the highest point on the pouring surface.

Unfortunately, it has often been impractical to incorporate satisfactory non-drip characteristics in large numbers of mass produced containers. These containers, such as salad oil bottles, are often manufactured by a process that does not permit the desired lip configuration to be reliably and repeatedly formed at a reasonable cost. Moreover, the materials of which such containers are made are too easily wetted to effectively prevent drippage. Consumer dissatisfaction with the pour characteristics of these containers is aggravated by the fact that the containers are sometimes used over and over again to pour relatively small quantities. The dripped contents tend to accumulate on the outside of the container, leading to a messy and potentially unsanitary condition.

One known solution to the above problem is the use of a fitment, a small permanent attachment to the mouth of the container that forms the pouring surface. There are, however, a number of important problems and disadvantages associated with the use of known fitments. It is difficult to obtain a good seal between the fitment and the container because of the relatively large tolerances generally associated with such containers. Leakage can occur between the fitment and the cap or closure of the containers. Still another problem is damage to the fitment resulting from deformation of the cap, which may occur during shipment or after purchase.

It should also be appreciated that the addition of a fitment to a cap and closure packaging system necessarily converts that system from a two-element system to a three-element system. Tolerance requirements imposed by the fitment and assembly complexities attributable to the fitment must therefore be minimized if unacceptable costs are to be avoided.

The objective of the present invention is to provide a fitment, and a container, closure and fitment combination that overcomes the disadvantages of previously known fitments and satisfies the design criteria set forth above.

SUMMARY OF THE INVENTION

The present invention accomplishes the above objective. One aspect of the invention resides in the fitment itself which includes an annular retainer portion defining an inwardly facing annular recess and a ring extending upwardly from the retainer portion. A sealing bead extends downwardly from the retainer and a lip that defines a pouring surface extends outwardly from the top of the ring.

The fitment is used in combination with a container having an opening at the top and an outwardly projecting annular holding portion surrounding the opening and received by the recess. A closure that is releasably secured to the container has an inner surface that engages the lip and presses it downwardly, thereby forcing the sealing bead against the holding portion in a liquid-tight relationship.

The closure may include a downwardly extending support member that engages the retainer portion of the fitment. Preferably, the support member is annular and is received at its lower end by an upwardly facing positioning channel defined by the retainer portion. The support member forms part of the inner closure surface that engages the lip, that surface preferably defining an annular cradle.

In its preferred form, the retainer portion includes a sidewall, a top segment extending inwardly from the sidewall to engage the top of the holding portion, and a snap bead extending inwardly from the sidewall to engage the bottom of the holding portion. The holding portion is thus resiliently grasped between the top segment and the snap bead.

The closure can be secured to the container by mutually engaging threaded surfaces. This arrangement permits the closure to be held down tightly against the fitment, pushing the fitment against the container.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figure 1:
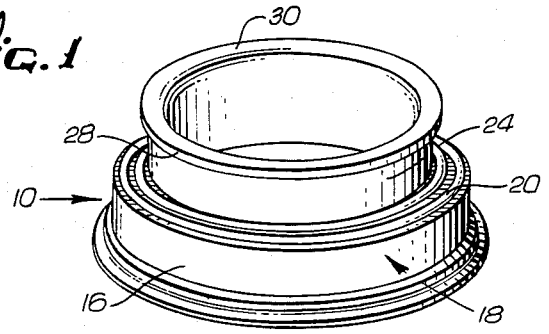
FIG. 1 is a perspective view of a fitment constructed in accordance with the present invention.
Figure 4:
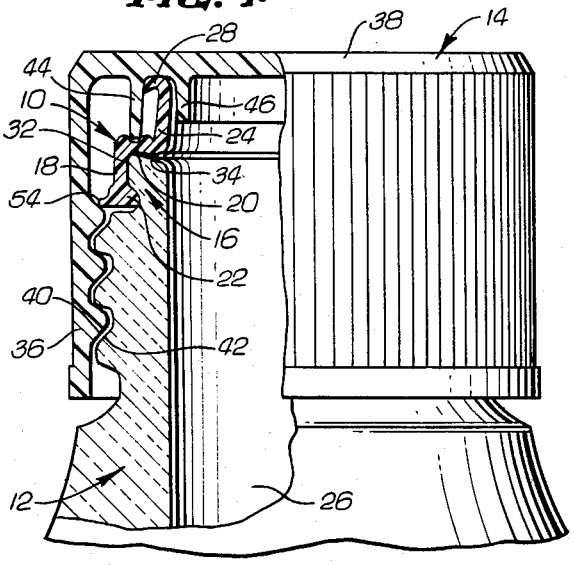
FIG. 4 is a partially broken away side elevation of the fitment and closure of FIG. 3 installed in a container, only a fragmentary upper portion of the container being shown.

A fitment 10, shown separately in FIG. 1, is used in combination with a container 12 and a closure 14, as shown in FIG. 4. The relationship of these components to each other when in use will be described first and then the preferred method of making and installing the fitment will be explained.

The fitment 10 includes a retainer portion 16 having an annular sidewall 18, a top segment 20, and a snap bead 22. Extending upwardly from the inner end of the top segment 20 is a ring 24 that forms a short tabular extension of an opening 26 at the top of the container 12. At the top of the ring 24 is an outwardly extending lip 28 that defines a no-drip pouring surface 30.

Figure 5:
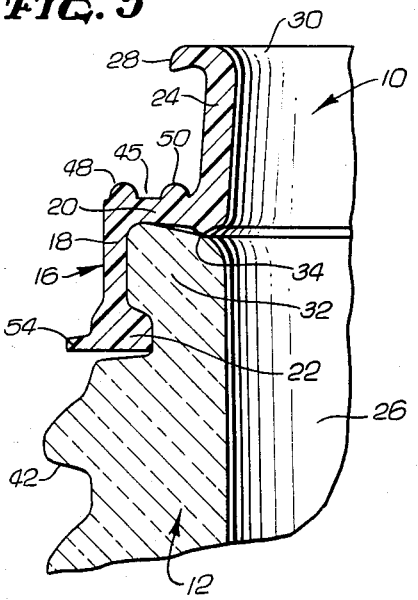
FIG. 5 is an enlarged fragmentary cross-sectional side view of the fitment and container of FIG. 4.

The retainer portion 16 of the fitment 10 defines an inwardly facing recess that receives a holding portion 32 of the container 12, as best shown in FIG. 5. Conforming to the shape of the holding portion 32, the top segment 20 extends downwardly as well as inwardly and the snap bead 22 fits under a lower surface of the holding portion 32. The retainer portion 16 must be stretched slightly to fit over the holding portion 32 and it thus grasps the holding portion resiliently, the snap bead 22 acting as a fulcrum. An annular sealing bead 34 on the bottom of the top portion 20 firmly engages the holding portion 32 in a high pressure, liquid-tight relationship.

The closure 14 has a cylindrical sidewall 36 and a flat top 38, as best shown in FIG. 4. It has an internal threaded surface 40 that mates with an external threaded surface 42 of the container 12 just below the holding portion 32.

On the inside of the closure 14 are two downwardly extending concentric annular projections 44 and 46 defining between them a downwardly facing annular cradle with an inner surface of approximately arcuate cross section that engages the pouring surface 30 of the lip 28. The dimensions and shape of the closure 14 are such that the closure, when fully screwed onto the container 12, will not permit the lip 28 to assume its relaxed configuration shown in FIG. 5. Instead, the lip 28 is bent slightly downwardly in an elastic manner by the closure 14. This bending of the lip 28 insures a tight seal despite any surface irregularities of the closure 14 and despite a range of possible positions of the closure relative to the container 12. When the the closure 14 is removed from the container 12, the lip 28 returns to its desired configuration, presenting an effective pouring surface, as shown in FIG. 5.

The outer projection 44 of the closure 14 forms a support member that is received by an upwardly facing circular positioning channel 45 (see FIG. 5) defined between two concentric positioning beads 48 and 50 on the top segment 20 of the retainer portion 16 of the fitment 10. This positioning channel 45 is disposed laterally between the sidewall 18 and the sealing bead 34. Thus, the closure 14, when installed in the container 12, tightens and pulls the sidewall 18 against the holding portion 32 of the container and exerts a downward force on the sealing bead 34, increasing the force attributable to the resiliance of the fitment 10 to prevent leakage between the fitment 10 and the container 12. The resulting force that constantly urges the lip 28 against the closure 14 is sufficient to prevent any leakage between the fitment 10 and the closure 14 and can eliminate the need for a soft gasket-like insert in the closure that otherwise would be required. The components need not be held to close tolerances and a satisfactory seal is formed by the sealing bead 34 and the snap bead 22.

An additional function of the support member 44 is to support the top 38 of the closure 14. Any downward force applied to the closure 14 would be resisted by this support member 44 and would prevent downward deflection of the top 38 that might otherwise result in undesired inelastic deformation of the lip 28 and its pour surface 30. The engagement of the support 44 by the channel 45 also stabilizes the closure 14 against lateral and radial movement.

Figure 2:
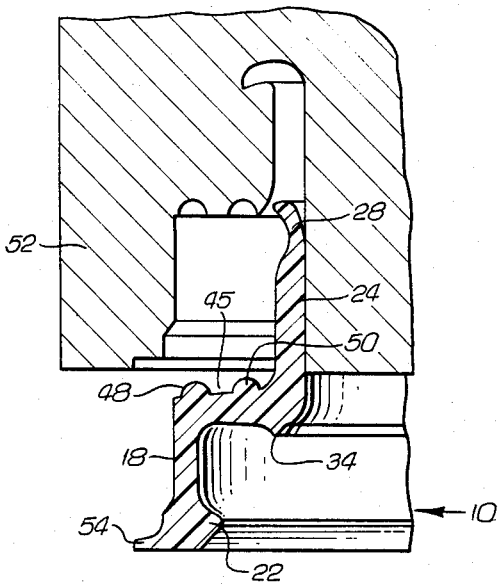
FIG. 2 is a fragmentary cross-sectional view of the fitment being withdrawn from a mold component.
Figure 3:
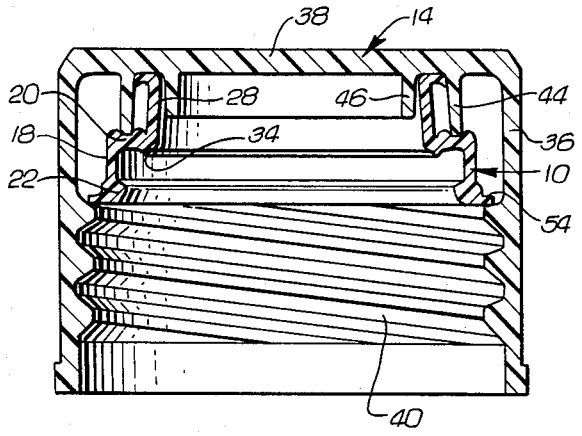
FIG. 3 is a cross-sectional side view of the fitment of FIGS. 1 and 2 installed in a closure.

The manufacture and installation of the fitment 10 will now be explained. The fitment 10 is injection strip molded of a relatively high elasticity plastic. When it is withdrawn from the mold 52, however, as shown in FIG. 2, the lip 28 is forced to assume a relatively upright, although slightly angled, position and will not, by itself, return to a position in which the pour surface 30 has the desired configuration of FIG. 5 unless the mold 52 is of a relatively complex construction. But the lip 28 is reconformed when the fitment 10 is forced fully into the closure 14, as shown in FIG. 3, prior to being installed on the container 12. In this way, the fitment 10 is custom formed to mate with an individual closure 14 and inelastically deformed to the extent that it assumes the configuration shown in FIG. 5 when removed from the closure 14. The interior surface of the closure 14 is configured to produce the desired inelastic deformation of the lip 28.

Once the fitment 10 has been installed in the closure 14, it is retained by a small radially projecting annular installation foot 54 that engages the top of the threaded surface 40 of the closure 14, as shown in FIG. 3. The fitment 10 is then installed on the container 12 by simply screwing the closure 14 onto the container, as shown in FIG. 4. The retainer portion 16 of the fitment 10 deforms elastically sufficiently to permit the snap bead 22 to pass over the holding portion 32 of the container 12. After the fitment 10 has been installed on the container 12 in this way, the installation is permanent. When the closure 14 is removed from the container 12, the foot 54 deforms elastically by bending at its upper end, allowing it to pass over the threaded surface 40 of the closure 14.

A plastic composition that has been found to work well for both the fitment 10 and the closure 14 is a mixture of 70 to 90 percent polypropylene. The preferred physical properties of this mixture are as follows:

melt index: 8.0 to 12.0
tensile at yield: 4500 to 5500 psi
flex modulous: 150,000 to 300,000 psi
izod impact notched at 23° C.: 0.5 to 1.0 ft.lb.
density: 9.04 to 9.08 g/cm$^3$
deflection temperature at 66 psi: 220° to 240° F.

There may, of course, be other plastics that are suitable and the scope of the invention is not limited to this particular formulation.

It will be noted that the invention provides a simple pouring fitment 10 that does not require that close tolerances be maintained in either the container 12 or the closure 14. Leakage between the container 12 and the fitment 10 or between the fitment 10 and the closure 14 is prevented and the fitment is easily installed on the container by simply installing the closure in the usual manner.

While a particular form of the invention has been illustrated and described, it will be apparent that various modifications can be made without departing from the spirit and scope of the invention.

We claim:

1. A pouring fitment for a container comprising:

an annular retainer portion defining an inwardly facing annular recess to receive an outwardly extending annular holding portion of a mating container;

an upwardly facing annular channel defined by said retainer portion to receive a downwardly extending support member that forms part of said closure;

a ring extending upwardly from said retainer portion;

an annular lip extending outwardly from the top of said ring and defining a pour surface; and an annular sealing bead extending downwardly from said retainer portion to engage said holding portion of said container, whereby a downward force applied to said lip and said ring by the installation of a closure on said container urges said bead toward a liquid-tight sealing relationship with said holding portion.

2. The fitment of claim 1 wherein said retainer portion includes two annular concentric positioning beads that define said channel.

3. The fitment of claim 1 further comprising an installation foot extending radially outwardly from said retainer portion.

4. A container, fitment and closure combination comprising:

a container having an opening at the top end thereof and an outwardly projecting annular holding portion surrounding said opening;

a fitment comprising:

(a) an annular retainer portion defining an inwardly facing annular recess that receives said holding portion, (b) a ring extending upwardly from said retainer portion to define an upward extension of said opening, (c) an annular lip extending outwardly from said ring and defining a pouring surface, and (d) an annular sealing bead extending downwardly from said retainer portion to engage said holding portion of said container; and a closure that engages said container and is releasably secured thereto, said closure comprising:

(a) an inner surface that engages said lip and presses downwardly thereon, thereby forcing said sealing bead against said holding portion in a liquid-tight relationship;

(b) a support member that extends downwardly into engagement with said retainer portion; and (c) a cradle partially defined by said support member that in which said lip is received, said lip being elastically deformed by said cradle.

5. The combination of claim 4 wherein said retainer portion includes two annular concentric positioning beads that define said channel.

6. The combination of claim 4 wherein said retainer portion includes a sidewall, a top segment extending inwardly from said sidewall and carrying said sealing bead on a bottom surface thereof, and a snap bead extending inwardly from said sidewall and engaging a lower surface of said holding portion, said retainer portion resiliently grasping said holding portion between said top segment and said snap bead.

7. The combination of claim 6 wherein said top segment extends downwardly as well as inwardly from said sidewall.

8. The combination of claim 4 wherein said closure and said container have mutually engaging threaded surfaces.

9. A container, fitment and closure combination comprising:

a container having an opening at the top end thereof and an outwardly projecting annular holding portion surrounding said opening;

a fitment comprising:

(a) an annular retainer portion defining an inwardly facing annular recessed positioning channel that receives said holding portion, (b) a ring extending upwardly from said retainer portion to define an upward extension of said opening, and (c) an annular lip extending outwardly from said ring and defining a pouring surface; and a closure that engages said container and is releasably secured thereto, said closure defining a downwardly facing annular cradle with an inner surface of approximately annular cross section that engages and elastically deforms said lip, bending said lip downwardly, said closure including a downwardly extending support member received by said channel.

10. The combination of claim 9 wherein said cradle is partially defined by said support member.

11. The combination of claim 9 wherein said closure and said container have mutually engaging threaded surfaces.

12. A container, closure and fitment combination comprising:

a container having an opening at the top end thereof, an outwardly projecting annular holding portion surrounding said opening and a threaded surface below said holding portion;

a fitment comprising:

(a) an annular retainer portion defining an inwardly facing annular recess that receives and elastically grasps said holding portion, a top portion extending inwardly and downwardly from said sidewall, and defining an upwardly facing annular positioning channel, and a snap bead extending inwardly from said sidewall and engaging a lower surface of said holding portion, (b) a ring extending upwardly from said top portion to define an upward extension of said opening, (c) an annular lip extending outwardly from the top of said ring and defining a three dimensionally curved pouring surface, and (d) an annular sealing bead extending downwardly from said retainer portion to engage said holding portion of said container; and a closure that releasably engages said threaded surface of said container, said closure including a downwardly extending support member that engages said positioning channel and a downwardly facing cradle in which said lip is received and elastically deformed, said cradle being partially defined by said support member.

13. The combination of claim 4, 9 or 12 wherein said fitment and said closure are formed of 70 to 90 percent polypropylene and 10 to 30 percent polyethylene.

* * * * *